US011566857B2

(12) United States Patent
Godzina et al.

(10) Patent No.: US 11,566,857 B2
(45) Date of Patent: Jan. 31, 2023

(54) PROTECTION DEVICE FOR A HEAT EXCHANGER

(71) Applicant: Valeo Autosystemy Sp. z o.o., Skawina (PL)

(72) Inventors: Radoslaw Godzina, Skawina (PL); Grzegorz Cyganek, Skawina (PL); Tomasz Wator, Skawina (PL); Lukasz Barus, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 0 days.

(21) Appl. No.: 16/648,410

(22) PCT Filed: Sep. 18, 2018

(86) PCT No.: PCT/EP2018/075147
§ 371 (c)(1),
(2) Date: Mar. 18, 2020

(87) PCT Pub. No.: WO2019/053278
PCT Pub. Date: Mar. 21, 2019

(65) Prior Publication Data

US 2021/0364240 A1 Nov. 25, 2021

(30) Foreign Application Priority Data

Sep. 18, 2017 (EP) ..... 17461605

(51) Int. Cl.
*F28F 19/00* (2006.01)

(52) U.S. Cl.
CPC ..... *F28F 19/002* (2013.01); *F28F 2265/02* (2013.01); *F28F 2265/30* (2013.01)

(58) Field of Classification Search
CPC .... F28F 2265/02; F24D 19/067; B60R 19/52; B60R 2019/525; B60K 11/04
See application file for complete search history.

(56) References Cited

U.S. PATENT DOCUMENTS 1,496,661 A 6/1924 Dreier
1,571,354 A * 2/1926 Whitacre ..... B60R 19/52 180/68.6

(Continued)

FOREIGN PATENT DOCUMENTS

EP 2495521 A1 9/2012
WO 2016-177826 A1 11/2016
WO 2016-177831 A1 11/2016

OTHER PUBLICATIONS

International Search Report and Written Opinion in corresponding International Application No. PCT/EP2018/075147, dated Dec. 19, 2018 (8 pages).

(Continued)

*Primary Examiner* — Jianying C Atkisson
*Assistant Examiner* — For K Ling
(74) *Attorney, Agent, or Firm* — Osha Bergman Watanabe & Burton LLP

(57) ABSTRACT

A protection device 1 for a heat exchanger, comprising a grid 10 with an upstream surface 11 and a downstream surface 12, both located on opposite sides of the grid 10, the grid 10 being attachable to the heat exchanger 40 with attachment means 11 so that the downstream surface 12 can face a side of the heat exchanger 40, wherein the protection device 1 further comprises a shock absorber 20 attached to the grid 10 so that the shock absorber 20 least partly protrudes from the downstream surface 12 of the grid 10.

5 Claims, 2 Drawing Sheets

(56) References Cited

U.S. PATENT DOCUMENTS 1,704,210 A * 3/1929 Race ..... B60K 11/04 180/69.2
1,841,888 A * 1/1932 Green ..... B60R 19/52 180/68.6
1,894,715 A * 1/1933 Smith ..... B60R 19/52 160/89
1,959,953 A * 5/1934 Green ..... B60R 19/52 180/68.6
2,206,023 A * 7/1940 Broadwell ..... B60R 19/52 293/145
3,700,061 A * 10/1972 Hortnagl ..... B60K 11/04 180/68.4
3,929,201 A * 12/1975 Hoffman ..... B60K 11/04 180/68.4
3,938,587 A * 2/1976 Vian ..... B60K 11/04 165/76
4,121,682 A * 10/1978 Schaal ..... B60K 11/04 180/68.4
4,916,902 A * 4/1990 Pratt ..... F01P 7/12 123/41.05
4,979,584 A * 12/1990 Charles ..... B60K 11/04 165/121
5,042,575 A 8/1991 Lindsay
2007/0120301 A1* 5/2007 Domen ..... F16F 1/3732 267/152
2007/0246280 A1* 10/2007 Maeda ..... B60K 11/04 180/68.4
2010/0078149 A1* 4/2010 Yoshimitsu ..... B62D 25/084 165/67
2012/0222837 A1* 9/2012 Lanfranco ..... F28F 19/002 165/67
2018/0120040 A1* 5/2018 Bireaud ..... F28F 9/0135

OTHER PUBLICATIONS

Second Office Action issued in corresponding Chinese Patent Application No. 201880068537.8, dated Dec. 23, 2021 (10 pages).

* cited by examiner

PROTECTION DEVICE FOR A HEAT EXCHANGER

FIELD OF THE INVENTION

The invention relates to a protection device for a heat exchanger.

BACKGROUND OF THE INVENTION

Heat exchangers interact with a fluid circulation loop in order to generate heat exchange between the outside air of the motor vehicle directed to pass through these heat exchangers and the fluid. It may be a coolant fluid, a refrigerant fluid or a gaseous fluid such as an intake air flow for an internal combustion engine.

These heat exchangers may consist of radiators, condensers or supercharged air coolers. In these heat exchangers, several tubes are stacked on top of each other with heat dissipating elements arranged in-between. The fluid circulates inside the tubes and participates in heat exchange with the outside air which passes through the dissipating elements of the heat exchanger.

These heat exchangers are conventionally arranged on the front face of motor vehicles in order to capture the outside air, ahead of the engine which is placed in the engine compartment of the motor vehicle.

The frontal position of these heat exchangers exposes the heat exchanger which is closest to the front face of the motor vehicle to the projection of debris or gravel which are on the road and which can damage or even pierce the tubes inside which the fluid circulates. More specifically, the tubes of the heat exchanger arranged closest to the front face of the motor vehicle are generally arranged transversally to the running direction of the motor vehicle in a flat and horizontal arrangement. As a result, the tubes of this heat exchanger located closest to the front face of the motor vehicle are exposed to the projections of debris or gravel at their edges facing the front face of the vehicle.

In order to protect these heat exchangers, it is known to place in front of them a protective grid capable of retaining the gravel or any other projectile and thus preventing shocks on the tubes of the heat exchangers. It is known for example to arrange a protective grid ahead of the heat exchanger(s) of the motor vehicle, by clipping this protective grid onto the heat exchanger.

However, additional elements such as protective grids may under specific circumstances apply shocks to the heat exchanger, for example upon being hit by debris, or during normal lifecycle operation. Consequently, instead of protecting the heat exchanger, they may actually be a source of damage themselves. Additionally, protective grids may produce noise when vibrating. Driving comfort of vehicle passengers as well as the rest of traffic participants is then lowered.

Thus, one of the aims of the present invention is to reduce or eliminate the abovementioned disadvantages.

SUMMARY OF THE INVENTION

The object of the invention is, among others, a protection device for a heat exchanger, comprising a grid with an upstream surface and a downstream surface, both located on opposite sides of the grid, the gird being attachable to the heat exchanger with attachment means so that the downstream surface can face a side of the heat exchanger, wherein the protection device further comprises a shock absorber attached to the grid so that the shock absorber least partly protrudes from the downstream surface of the grid.

Advantageously, the attachment means are situated at the sides of surfaces.

Advantageously, the attachment means are configured to provide a distance (D) between the downstream surface and the side of the heat exchanger after assembly.

Advantageously, the shock absorber protrudes from the downstream surface of the grid at a distance smaller than said distance (D).

Advantageously, the shock absorber comprises an elastomeric contact portion.

Advantageously, the grid comprises a mounting point in which the shock absorber is mounted releasably.

Advantageously, the shock absorber further comprises a conical insert portion connected to the contact portion by a cylindrical connecting portion, the connecting portion having a diameter smaller than the base of the conical insert portion.

BRIEF DESCRIPTION OF DRAWINGS

Examples of the invention will be apparent from and described in detail with reference to the accompanying drawings, in which.

DETAILED DESCRIPTION OF EMBODIMENTS

Figure 1:
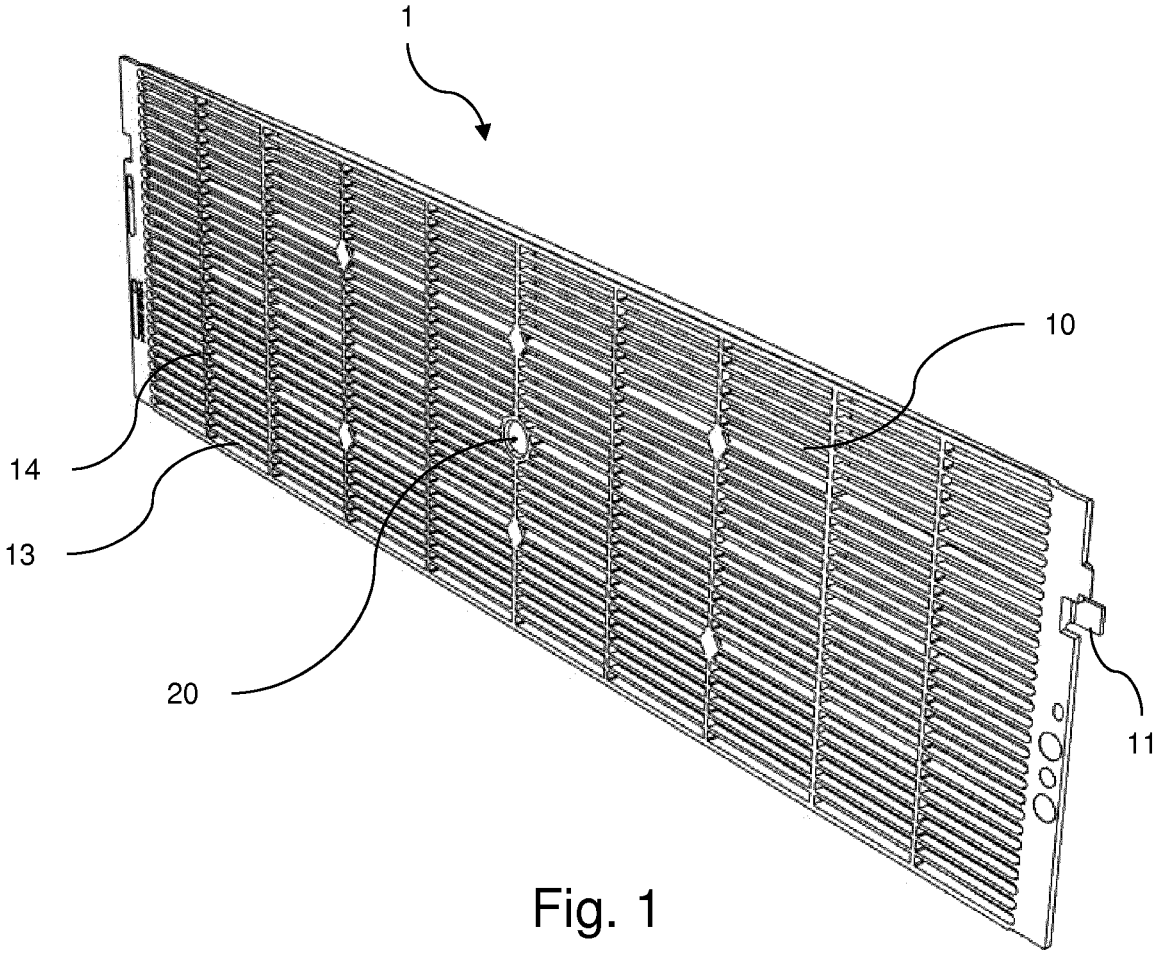
FIG. 1 shows a protection device according to the invention.

FIG. 1 shows a protection device 1 according to the invention. The protection device 1 comprises a grid 10 attachable to a heat exchanger 40 and a shock absorber 20 attached to the grid 10.

The grid 10 is configured to be arranged on a side of the heat exchanger 40, for example upstream the air flow direction, for example in front of the heat exchanger 40. The purpose of the grid 10 is to protect the selected side of the heat exchanger 40, while at the same time obstructing the flow of the fluid to a minimum extent. Such grid 10 can have first slates 13, arranged parallel to each other in a first direction while maintaining a distance between them, and second slates 14, arranged parallel to each other in a second direction, while maintaining a distance between them, so that the first slates 13 are traversed by the second slates 14. The first slates 13 and the second slates 14 can be perpendicular to each other. However, other shapes of the grid are also envisaged, as long as they allow the fluid to pass through the grid so that it can reach the face of the heat exchanger. Side walls of the slates form a front face of the grid and the rear face of the grid.

Slates of the grid 10 can be replaced by circular rods, square rods or other longitudinal elements, as long as they provide a resistant, physical barrier for debris of certain minimum dimensions and allow to arrange them in spaced manner for enabling fluid flow.

The grid 10 comprises an upstream face 11 and a downstream face 12, opposed to each other. The downstream face faces the heat exchanger 40 after attaching the grid 10 to the heat exchanger 40. The grid 10 can be attached to the heat exchanger 40 for example by means of attachment clips 11. Preferably, the attachment means 11 are situated at the sides of surfaces 11, 12. Advantageously, the attachment means 11 are located beyond slates 13, 14, so that the obstruction of incoming air is decreased. Further, such location facilitates operation of the shock absorber 20. The grid 10 can be attached to a heat exchanging module, i.e. the grid 10 can be attached to a casing which is a part of heat exchanging assembly comprising for example a condenser or a radiator or the like.

Figure 2:
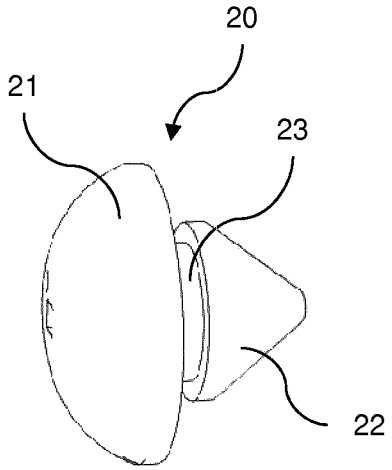
FIG. 2 shows an example of a shock absorbing element.
Figure 3:
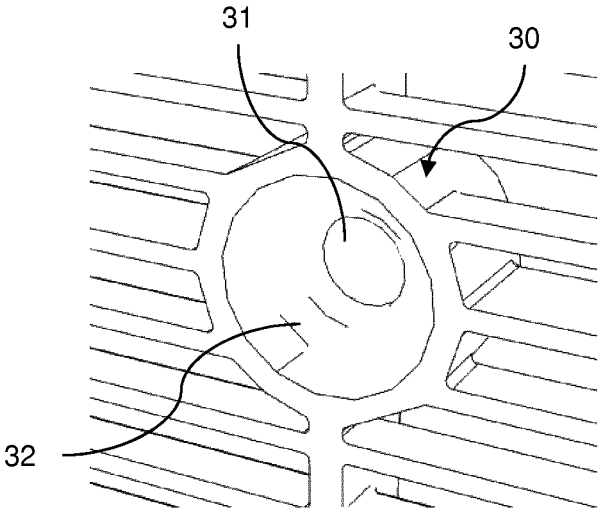
FIG. 3 shows an example of a mounting point for the shock absorbing element.

FIG. 2 shows an example of a shock absorber, while FIG. 3 presents an example of a mounting point for the shock absorber. As can be seen, the shock absorber 20 can be in form of a shaped bumper, while the mounting point 30 can be in form of a socket, into which the bumper can be plugged in. In greater detail, the shock absorber 20 can have a contact portion 21, intended for protruding out of the downstream surface 12 of the grid 10. This contact portion 21 can have a hemispherical shape. This part of the shock absorber 20 is intended as an element which will contact the heat exchanger 40 when the downstream face 12 moves towards it. Preferably, the contact portion 22 is made of an elastomeric material. The bumper can have further an insert portion 22, shaped so as to allow introduction of the bumper into the opening 31 of the socket of the mounting point 30. The insert portion 22 can be for example of conical shape.

Dimensions and shapes of this insert portion 22 are selected such that the insertion of the shock absorber into the socket is easier than removing said shock absorber from said socket. This can be achieved by pointing a top portion of the conical shape towards the opening of the socket, while arranging its wider part near the contact portion. In other words, the base of the conical insert portion 22 has a diameter larger than the diameter of the cylindrical connecting portion 23. Said contact portion is also of dimensions which make it hard or impossible to pass through the opening of the socket. Between the contact portion 21 and the insert portion 22 there is a connecting portion 23, which is passes through the opening of the socket after assembly, and thereby enables holding the bumper within the socket. Such arrangement allows a secure and easy mounting of the shock absorber, while at the same time providing a releasable nature of the connection. Thus an option of servicing or replacing the shock absorber is provided.

Figure 4:
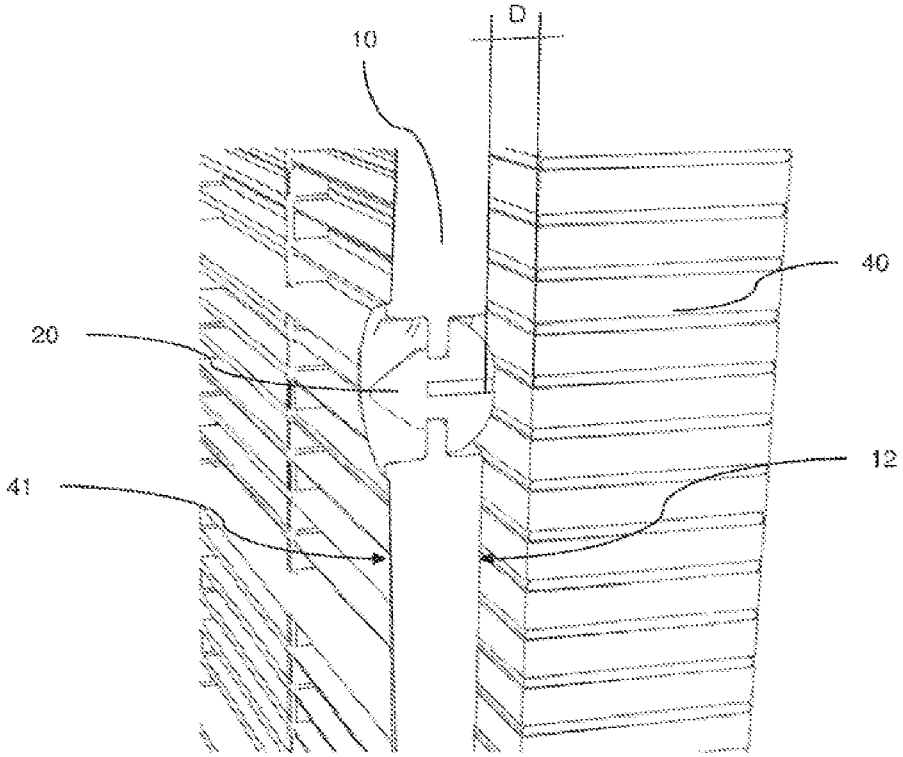
FIG. 4 shows details of the exemplary protection device cooperating with a heat exchanger.

FIG. 4 shows an details of the protection device 20 cooperating with a heat exchanger 40. The grid 10 has an upstream surface 11 (front surface) forming an entrance face of the air flow to the heat exchange device 40 and a downstream surface 12 (back surface), opposed to this upstream surface 14 and facing the inlet face of the heat exchanger 40. Both of them are located on opposite sides of the grid 10. The downstream surface 12 of the grid 10 can be substantially parallel to the face of the heat exchanger 40, that is to the face which is to be protected. This can be for example a front face of a condenser or a radiator.

The downstream surface 12 of the grid 10 is configured to be distanced from the face of the heat exchanger by a predetermined distance D. In particular, the attachment means 11 can be configured to provide this distance. The shock absorber 20 protrudes from the downstream surface 12 of the grid 10 at part of this distance D. In other words, the shock absorber 20 protrudes from the downstream surface 12 of the grid 10 at a distance smaller than said distance D. In this manner, the grid 10 is provided with a space in which it can deform and dissipate energy, for example due to vibrations or shock, without touching the heat exchanger with its portions other than those serving as attachment means 11.

Protection grid can be made in plastic injection process using composite materials. The shock absorber can be made in rubber vulcanization process using EPDM or during injection using silicone.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A protection device for a heat exchanger, comprising:

a grid with an upstream surface and a downstream surface, both located on opposite sides of the grid, the grid further comprising attachment means, the grid being configured to be attached to the heat exchanger via the attachment means so that the downstream surface faces a side of the heat exchanger; and a shock absorber attached to the grid so that the shock absorber at least partly protrudes from the downstream surface of the grid, wherein the attachment means are configured to provide a first distance between the downstream surface and the side of the heat exchanger after assembly, and wherein the shock absorber protrudes from the downstream surface of the grid at a second distance smaller than said first distance.

2. The protection device according to claim 1, wherein the attachment means are situated at the sides of the upstream and downstream sides of surfaces.

3. The protection device according to claim 1, wherein the shock absorber comprises an elastomeric contact portion.

4. The protection device according to claim 3, wherein the grid comprises a mounting point in which the shock absorber is mounted releasably.

5. The protection device according to claim 4, wherein the shock absorber further comprises a conical insert portion connected to the contact portion by a cylindrical connecting portion, the connecting portion having a diameter smaller than a base of the conical insert portion.

* * * * *